US010814941B2

(12) United States Patent
Kolb

(10) Patent No.: US 10,814,941 B2
(45) Date of Patent: Oct. 27, 2020

(54) ERGONOMIC KICKBOARD

(71) Applicant: Norah M. Kolb, Sandy Hook, CT (US)

(72) Inventor: Norah M. Kolb, Sandy Hook, CT (US)

( * ) Notice: Subject to any disclaimer, the term of this patent is extended or adjusted under 35 U.S.C. 154(b) by 0 days.

(21) Appl. No.: 16/418,033

(22) Filed: May 21, 2019

(65) Prior Publication Data

US 2019/0359296 A1 Nov. 28, 2019

Related U.S. Application Data

(60) Provisional application No. 62/675,574, filed on May 23, 2018.

(51) Int. Cl.

| | |
|---|---|
| ***B63B 32/53*** | (2020.01) |
| ***B63B 32/50*** | (2020.01) |
| ***B63B 32/70*** | (2020.01) |
| ***B63B 32/20*** | (2020.01) |

(52) U.S. Cl.

CPC ..... *B63B 32/53* (2020.02); *B63B 32/50* (2020.02); *B63B 32/70* (2020.02); *B63B 32/20* (2020.02)

(58) Field of Classification Search

CPC ..... B63B 1/00; B63B 49/00; B63B 32/70; B63B 35/79; B63B 35/7916; B63B 32/50; B63B 32/53; B63B 32/20; B63B 35/73; B63B 2035/7903

USPC ..... 441/65, 74; D21/769, 770, 801, 803

See application file for complete search history.

(56) References Cited

U.S. PATENT DOCUMENTS

| | | | | |
|---|---|---|---|---|
| 4,781,638 | A | 11/1988 | Winters, Jr. | |
| 4,932,912 | A | 6/1990 | Combs | |
| 5,518,429 | A | 5/1996 | Gravlin | |
| 5,634,834 | A | 6/1997 | Cole et al. | |
| D453,367 | S * | 2/2002 | Katz | D21/769 |
| D466,175 | S * | 11/2002 | Katz | D21/769 |
| 6,872,111 | B2 | 3/2005 | Katz et al. | |
| D590,470 | S * | 4/2009 | Mun | D21/769 |
| 7,798,876 | B2 | 9/2010 | Mix | |
| D627,026 | S | 11/2010 | Durocher | |
| D667,910 | S | 9/2012 | Behr | |
| 2014/0141667 | A1 | 5/2014 | DiLorenzo et al. | |

* cited by examiner

*Primary Examiner* — Lars A Olson

(74) *Attorney, Agent, or Firm* — Alix, Yale & Ristas, LLP

(57) ABSTRACT

A kickboard has a non-planar shape and comprises a primary panel with opposite support members laterally outside from the primary panel with a transitional section therebetween. The support members are at a rear longitudinal position and additional support shoulders may extend from a forward end of the primary panel along each lateral side to a respective support member. The rearward end defines an opening with a cavity formed between the primary panel, transitional sections, support shoulders and support members. In use, the kickboard provides substantially improved ergonomics and allows a swimmer to support her elbows on the support members with a portion of her forearms on the support shoulders, with arms in a bent position below the surface of the water. The configuration improves comfort while maintaining a favorable hydrodynamic swimming position and reducing shoulder stress.

20 Claims, 8 Drawing Sheets

ERGONOMIC KICKBOARD

This invention relates to equipment used in swimming and swim training, and more specifically a kickboard with support members shape configured for improved ergonomics.

BACKGROUND

In swimming, kickboards are used as a tool to isolate the leg muscles during training. Conventional kickboards are generally flat and configured to be used with the swimmer's arms fully extended ahead of the swimmers torso in the direction of travel. This most common position can stress the swimmer's shoulders, making use of a kickboard uncomfortable over time.

Other kickboards exist with various contours and shapes with alleged ergonomic benefits. However, none of these known kickboards allow a swimmer to support her arms and elbows in a bent position beneath the water to remain in a substantially prone position. Accordingly, there exists a need for a kickboard which provides such improved ergonomics during use and which encourages and allows a swimmer to remain in a prone position.

SUMMARY OF INVENTION

The inventive kickboard disclosed herein has a shape that allows a change in the arm position of the swimmer relative to known kickboards, which thereby reduces stress applied to the swimmer's shoulders.

A first embodiment of a kickboard includes a primary panel and a pair of support members. The primary panel defines a primary level and extends longitudinally from a forward end with a forward lateral width to a rearward end with a rearward lateral width that exceeds the forward lateral width. Each support member of the pair is positioned laterally on an opposite side of the primary panel, rear of the forward end, and at a height beneath the primary level. A transitional section on each lateral side of the primary panel transitions from the primary level proximate the forward end to a respective support member. Each support member is configured to receive and support a portion of the individual's arm beneath the primary level and laterally outside the primary panel.

In another embodiment, a kickboard comprises a primary panel and a pair of support members. The primary panel defines a primary level and extends longitudinally from a forward end to a rearward end and has a lateral width. Each support member of the pair is positioned laterally on an opposite side of the primary panel proximate the rear end and at a height beneath the primary level. A transitional section on each lateral side of the primary panel transitions downwardly from the primary level at the rearward end of the primary panel to a respective support member, thereby defining a hollow space between the primary panel and each transitional section at the rearward end.

In yet another embodiment, kickboard has a primary panel and a pair of support members. The primary panel defines a primary level and extends longitudinally from a forward end to a rearward end. The forward end has a forward lateral width and the rearward end has a rearward lateral width that exceeds the forward lateral width. Each support member of the pair is positioned laterally on an opposite side of the primary panel in a position rear of the forward end and at a height beneath the primary level. A transitional section on each lateral side of the primary panel transitions from the primary level proximate the forward end of the primary panel to a respective support member and includes a rear portion at the rearward end of the primary panel. The primary panel and the transitional sections define a hollow space therebetween that extends forwardly from the rearward end.

When the inventive embodiments of the kickboard are in use, the primary panel can lay substantially flat on the plane of the water surface. The support members provide a stable surface onto which the swimmer can rest her elbows (with a shelf for the swimmer's forearms in some embodiments). Importantly, this positioning places the swimmer's elbows and forearms below the surface of the water, unlike with known kickboards. Further, the swimmer's arms may be maintained with bent elbows (i.e., not fully extended). Each shelf extends from a forward position at a relatively shallow depth to a relatively deeper depth as it transitions rearward to the support member. In this bent arm position the point of force transfer from the kickboard to the swimmer is closer to the swimmer's shoulders than in an extended arm position, which reduces the resultant moment, thereby relieving shoulder stress and improving comfort relative to use of a conventional kickboard.

Additionally, embodiments of the disclosed kickboard can contribute to placing the transfer point of the board placed relatively beneath the body, the body results in a position similar to the "plank" position, a position known to help strengthen the abdominal and core muscles. As such, the kickboard not only is usable to strengthen one's legs, but abdominal and core muscles as well. The amount of core muscles worked may be adjusted to how much upper chest area is resting on the central portion of the board and angle of arms.

In one embodiment, the lateral spacing between contralateral locations of the support members and shelf increases moving rearward from the most forward portion of the kickboard. This may be provided by a primary panel that increases in width from front to rear.

In one embodiment, the kickboard is formed of a single component. In another embodiment the kickboard is comprised of multiple pieces that allow the kickboard to be partially or fully disassembled.

In one embodiment the kickboard has handles extending from the top surface that the swimmer grasps to maintain control of the kickboard. The handles also allow alternate hand and forearm positons that may further improve comfort.

BRIEF DESCRIPTION OF DRAWINGS

Aspects of the preferred embodiments will be described in reference to the drawings in which.

DETAILED DESCRIPTION

Among the benefits and improvements disclosed herein, other objects and advantages of the disclosed embodiments will become apparent from the following wherein like numerals represent like parts throughout the several figures. Detailed embodiments of a kickboard with improved ergonomics for us in swimming training are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
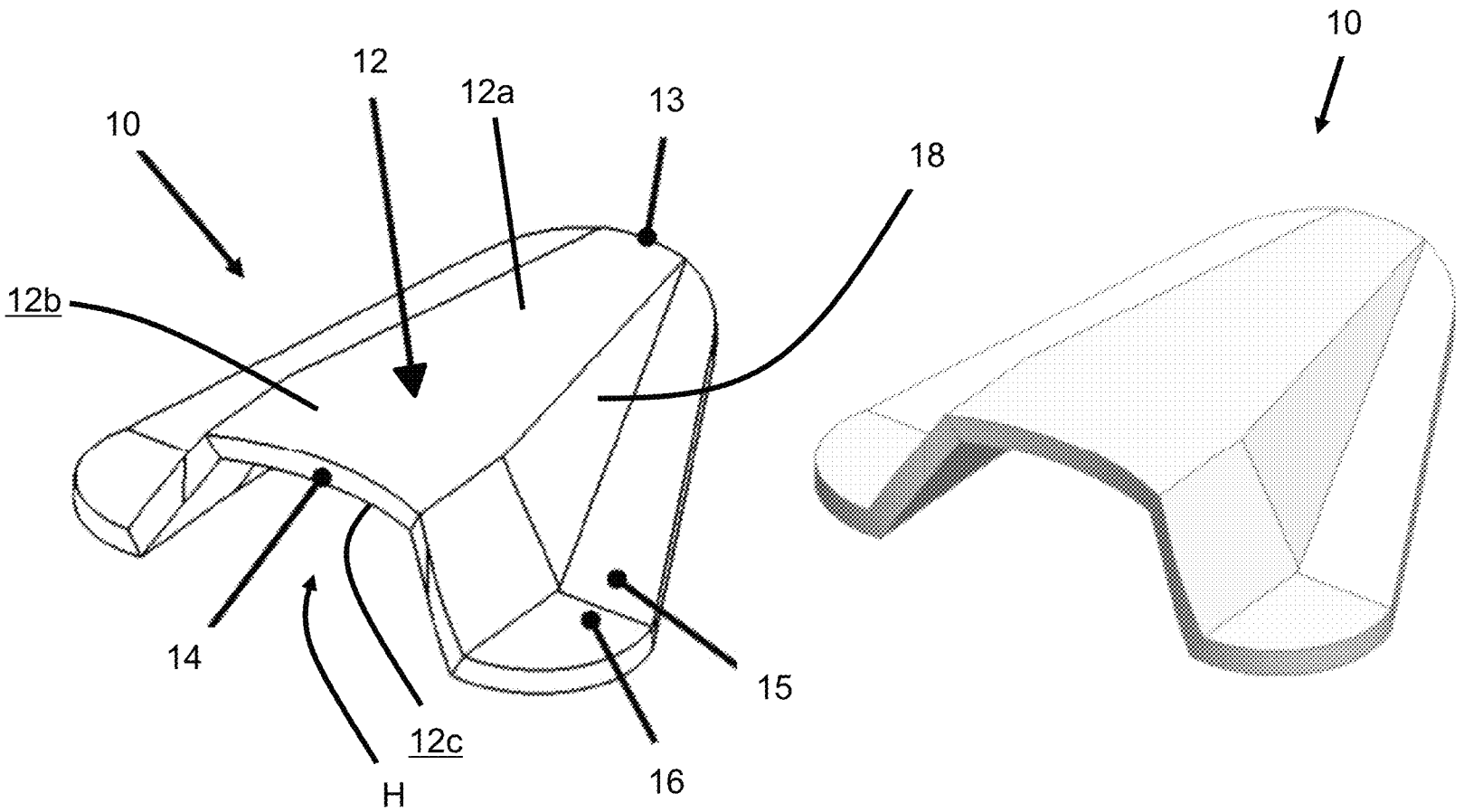
FIG. 1 is an isometric view of the disclosed kickboard.
Figure 2A:
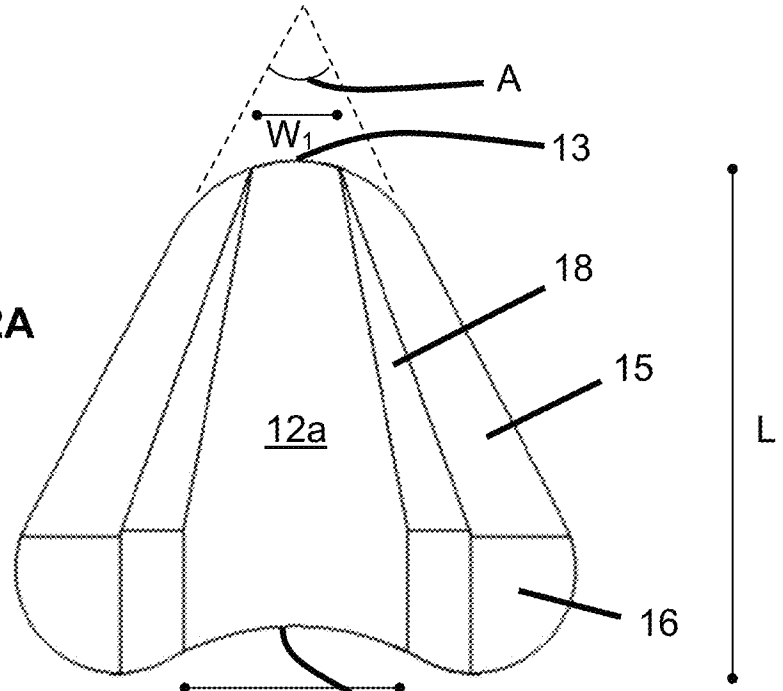
FIG. 2A is a top elevation view of the kickboard of FIG. 1.

FIG. 1 depicts a preferred embodiment of the kickboard 10, comprising primary panel 12 that extends longitudinally from a forward end 13 to a rearward end 14. As shown, the primary panel 12 defines a top primary level 12*a* with a top surface 12*b* and an opposite bottom surface 12*c* and has a forward lateral width $W_1$ and lateral edges that transition outward in the rearward direction to the rearward end 14 with a rearward lateral width W2. A transitional section 18 transitions generally downward from each lateral edge of the primary panel 12 to opposite support shelves 15 and support members 16, which are longitudinally positioned at the rear of the kickboard 10. As shown, the transitional sections extend obliquely from the respective lateral edges of the primary panel, which assists in positioning the respective support shelves 15 and support members 16 laterally to the outside of the primary panel 12. In the depicted embodiments, as especially seen in the top views of FIGS. 2A and 4, the support shelves 15 and support members 16 define the laterally outer periphery of the kickboard.

Figure 2B:
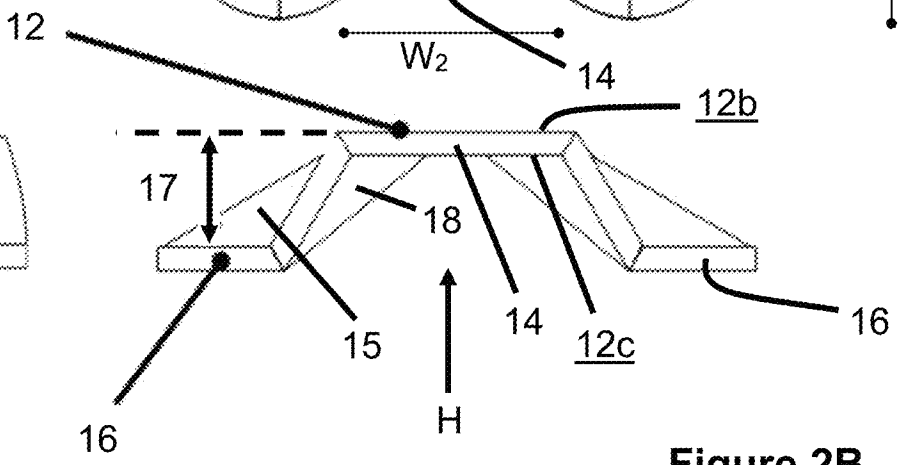
FIG. 2B is a rear elevation view of the kickboard of FIG. 1.
Figure 2C:
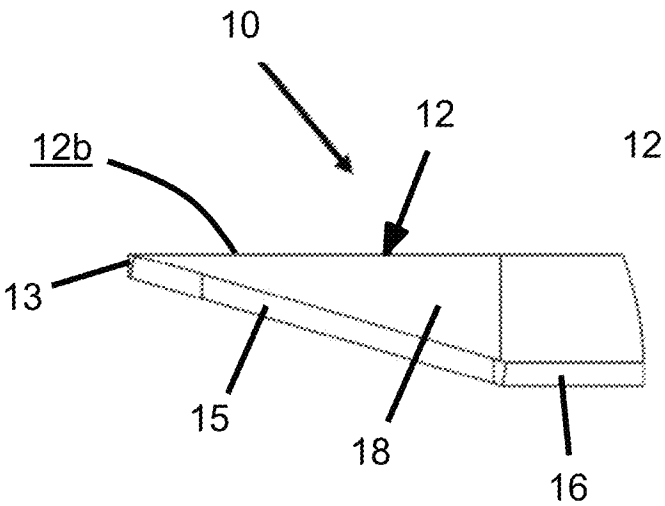
FIG. 2C is a side elevation view of the kickboard of FIG. 1.
Figures 6A, 6B, 6C:
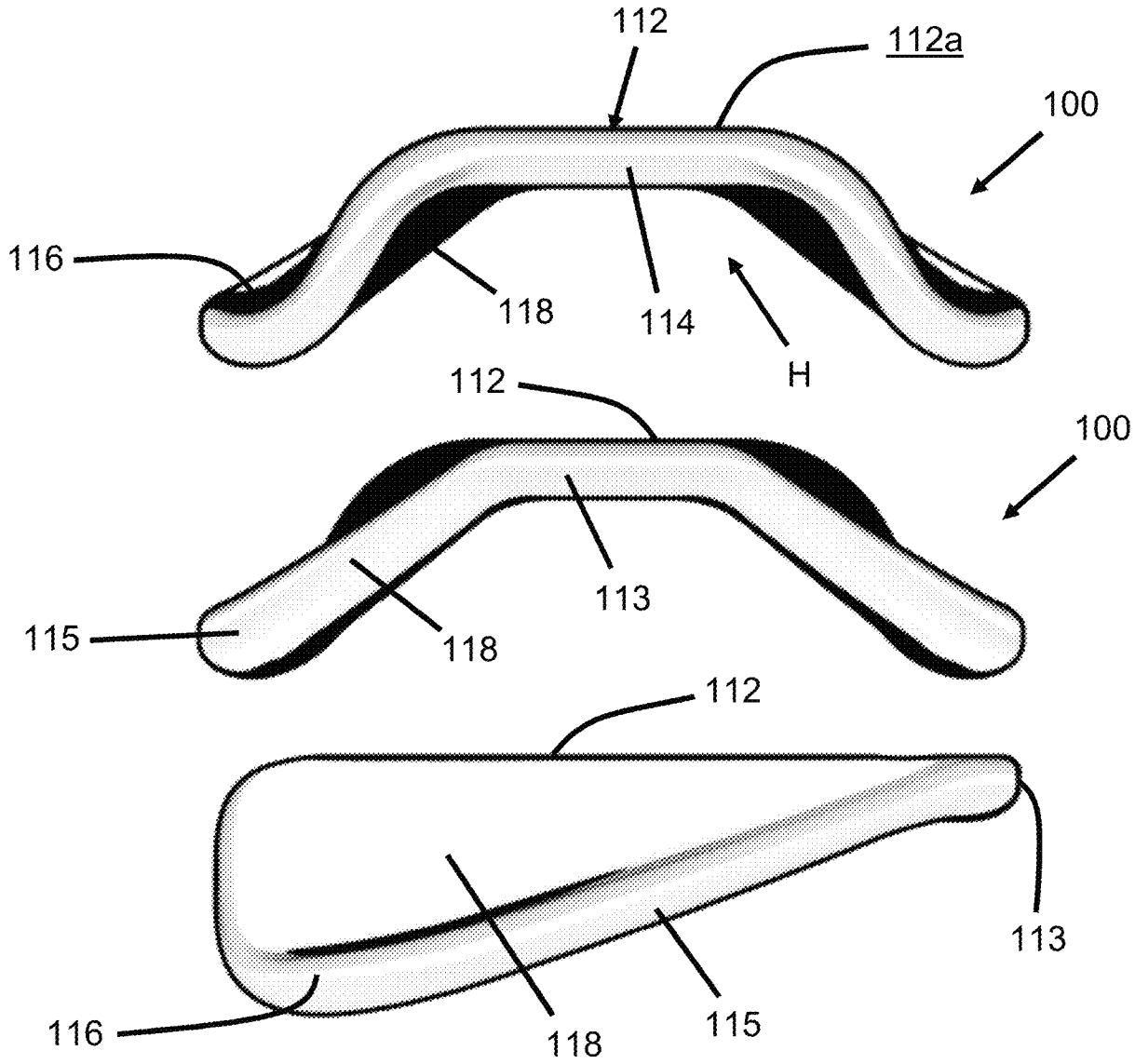
FIG. 6A is a rear elevation view of the kickboard of FIG. 5.
FIG. 6B is a front elevation view of the kickboard of FIG. 5.
FIG. 6C is a side elevation view of the kickboard of FIG. 5.

With reference to the side view of FIGS. 2C and 6C, the support shelves 15/115 transition downward from the forward end 13 in the rearward direction to the support members 16/116 that are positioned at the longitudinal rear of the kickboard 10 and 100. The configuration of the kickboard with support shelves and support members is such that a swimmer would typically grip the kickboard at a relatively forward location, and then rest her elbows on the support members and at least a portion of her forearms on the support shelves. In use in the water, it can be said that the shelves 15 extend from a shallow water depth to a deeper water depth from the forward end 13 rearward to the support members 16. Typically, the primary panel 12 has a greater surface area than each of the support shelves 15 and support members 16, however this is a non-limiting characteristic.

FIG. 2B depicts the height difference 17 defined between the primary level 12*a* and support members 16, which define the lowest portion of the kickboard in the depicted preferred embodiments. This height difference 17 places the swimmer's elbows substantially below the surface of the water during use. In certain embodiments, the height difference 17 is configured to be greater than the diameter of the swimmer's arms. In some embodiments the primary panel 12 has a substantially flat contour and the support members 16 are substantially parallel thereto. In one embodiment the rearward end 14 of the primary panel 12, optionally in combination with the transitional sections 18, has a concave contour as viewed from a top view (see FIG. 2A). Other embodiments exist with a convex or flat contour at the rearward end as viewed from the top.

Figure 3:
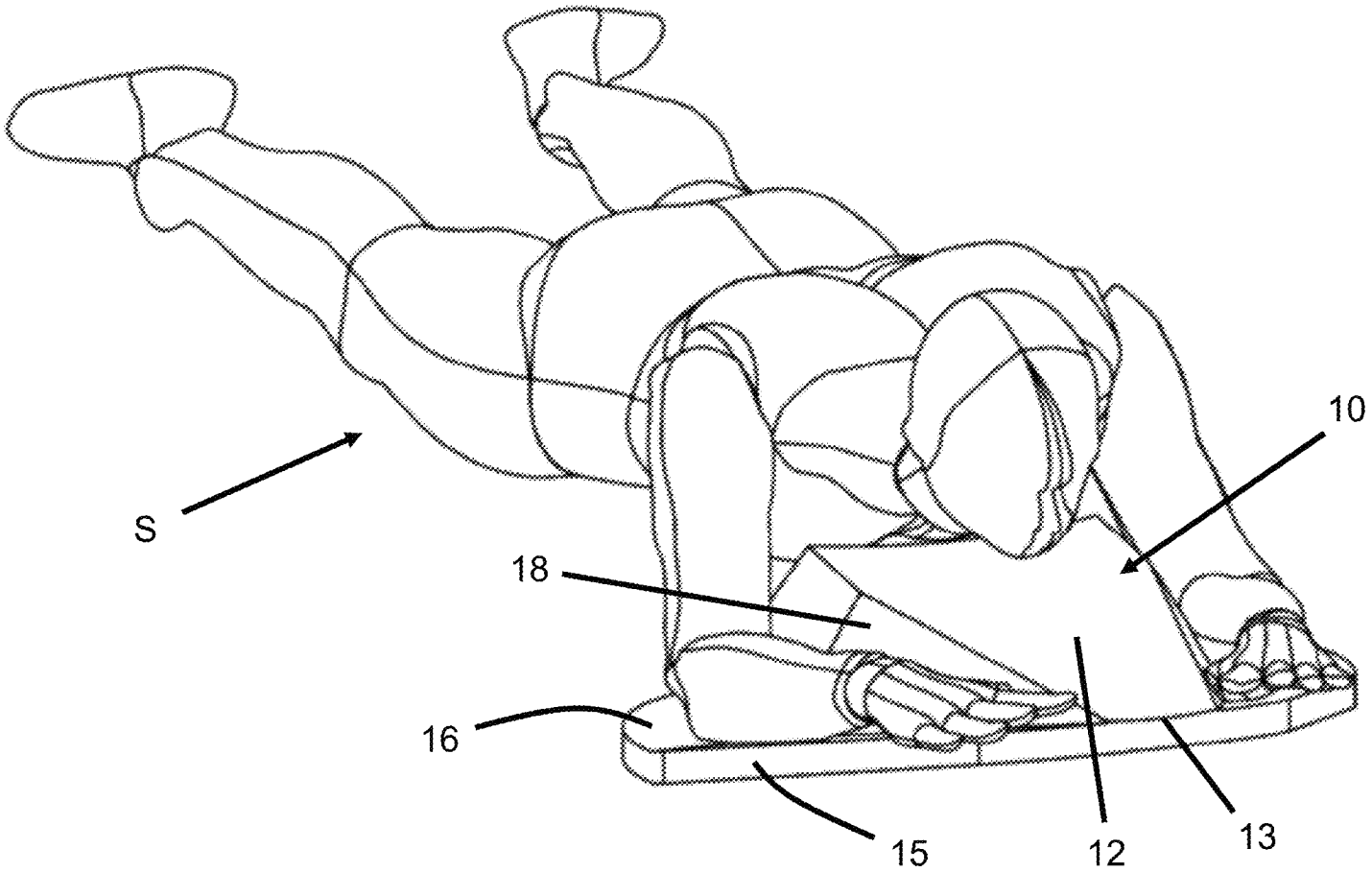
FIG. 3 shows the kickboard of FIG. 1 in use by a swimmer.

FIG. 3 depicts a swimmer using the kickboard in the water (water not shown) in a generally prone position with his hands placed near the most forward end 13 of the kickboard 10, forearms extending along the bilateral support shelves 15 and elbows positioned on the support members 16. The primary panel 12 extends substantially parallel or coplanar with the swimmer's generally flat torso with the swimmer's elbows beneath the water and the primary panel. In use, the swimmer's hands are at a higher position (less deep in the water) than the swimmer's elbows. The hands may be at, above or below the surface of the water during use.

Figure 4:
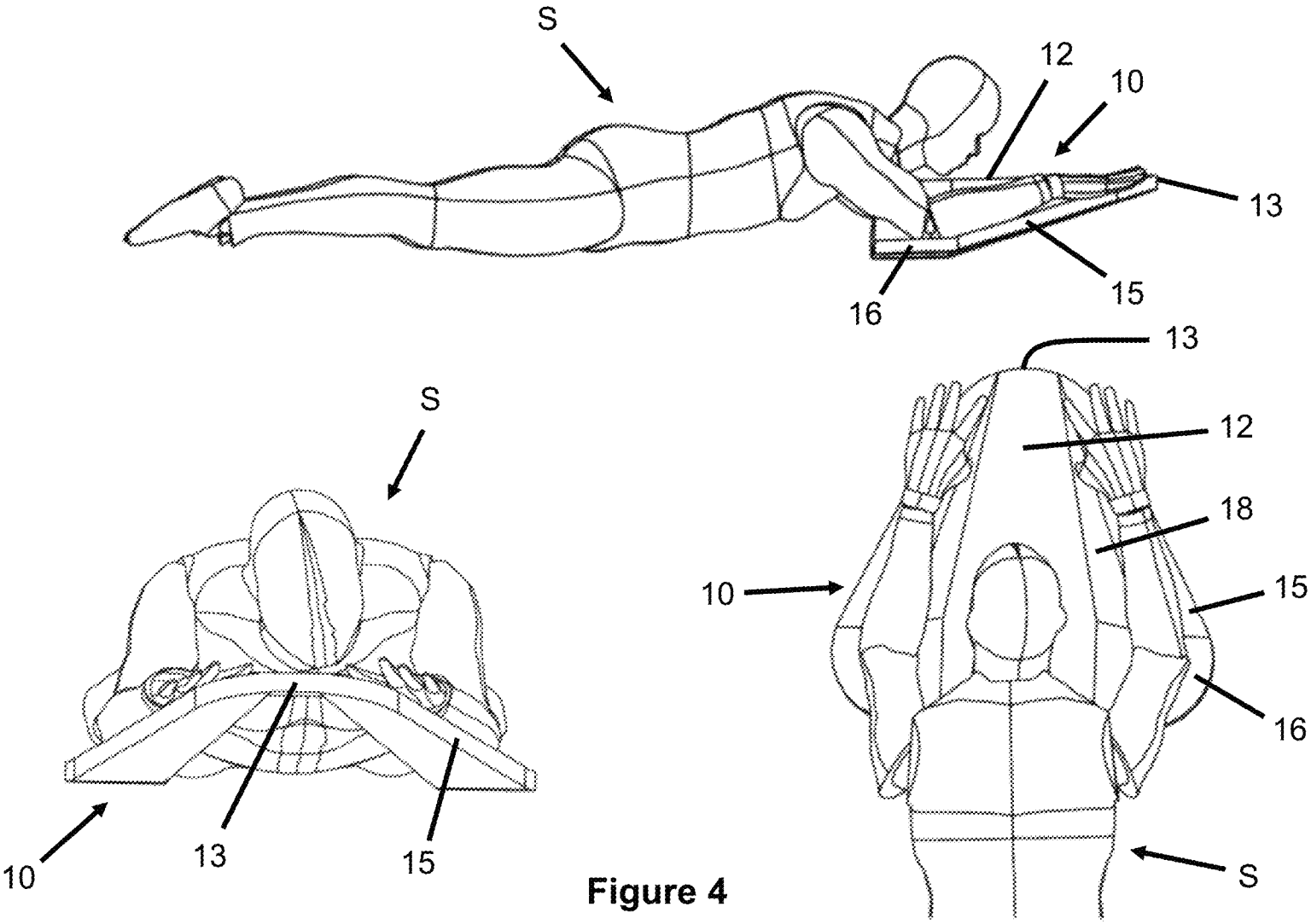
FIG. 4 shows side, front and top orthogonal views of the kickboard of FIG. 1 in use by a swimmer.

FIG. 4 presents orthogonal views of the swimmer using the kickboard 10 in the water (water not shown). The top view (bottom right depiction of FIG. 4) shows that the swimmer's elbows positioned laterally outside the lateral position of the swimmer's hands. Also notable in the depicted embodiment is that the kickboard 10 has a greatest lateral width (at the rearward end) that is configured to be approximately equal to or wider than the swimmer's shoulders, depending on the size of the swimmer. Additionally, the height difference 17 between the primary level 12*a* and support members 16 is set such that the support members 16 are at a height position beneath the water level and at a lateral position that encourages the swimmer's arms bend outward. This configuration causes the swimmer's head to be positioned rear of the kickboard with clearance for the swimmer to comfortably place her head in the water. With some swimmers, the height position of the support members 16 is at a position beneath the swimmer's chest during use (i.e., deeper in the water). Regardless of the relative size of the swimmer, and thus, the specific interaction with the kickboard, the kickboard encourages a more natural positioning of the swimmer's arms and reduces stress on the shoulders.

In another embodiment (not depicted), the most rearward portion of the respective support members slopes upward to form a pocket configured to receive and support the swimmer's bent elbow.

While the depictions of the kickboard 10 in FIGS. 1-4 show distinct edges between respective panels that make up the primary panel 12, transitional sections 18, support shelves 15 and support members 16, preferred embodiments of the kickboard exists with a substantially continuous body contour between respective elements, thereby omitting distinct edges.

Figure 5:
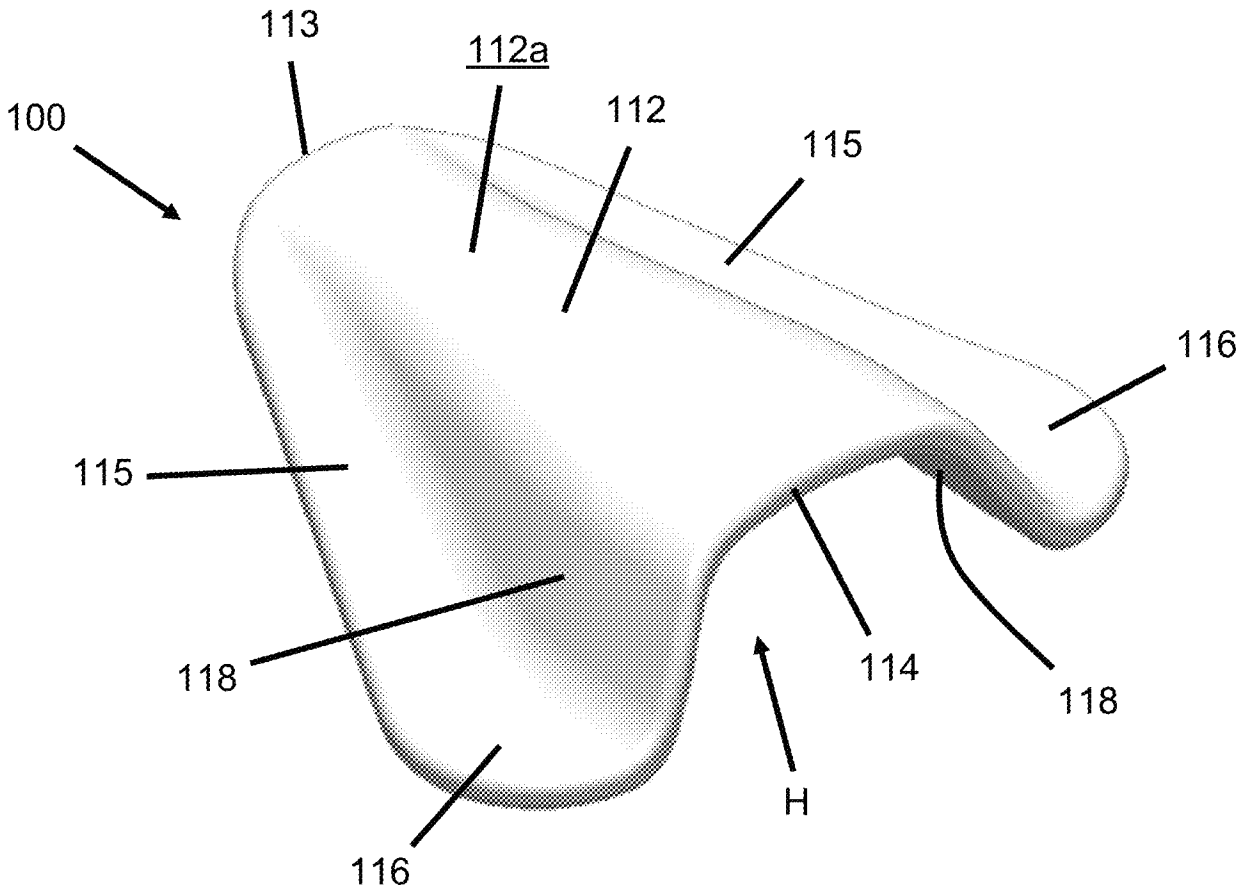
FIG. 5 shows another embodiment of the disclosed kickboard with smooth contour omitting distinct edges.

An embodiment of the kickboard 100 without distinct edges is shown in FIGS. 5-6C as referred briefly above. Notably, all elements that are common between the embodiment of the kickboard 10 and the embodiment of the kickboard 100 are identified with reference numerals having identical last two digits; reference numerals of the respective elements of the kickboard 100 include a preceding "1". The common elements and their relationships in the kickboard 100 are substantially identical to those in the kickboard 10, as can readily be understood with reference to FIGS. 5-6C.

In the depicted embodiments, the primary panel 12/112, transitional sections 18/118, support shelves 15/115, and support members 16/116 combine to define an inner hollow portion H with an open rear end. As shown most clearly in the rear views of FIGS. 2B and 6A, the rear opening of the hollow portion H has a substantially trapezoidal shape in the depicted preferred embodiments. Due to the shape of the primary panel 12/112, the hollow portion H necessarily narrows from the rearward end 14/114 toward the forward end 13/113. This can be understood clearly at least with reference to the perspective views (FIGS. 1 and 5) and the rear views (FIGS. 2B and 6A). Notably, in the rear views of FIGS. 2B and 6A, the transitioning sections 18/118 can be seen narrowing the area of the hollow portion H. The hollow portion H configured substantially as shown and described in combination with the other elements and relationships within the disclosed kickboard has been shown to provide optimal positioning in the water for a swimmer during training, allowing a preferred positioning of the swimmers arms and elbows in relation to her torso, encouraging the prone position.

Figure 7:
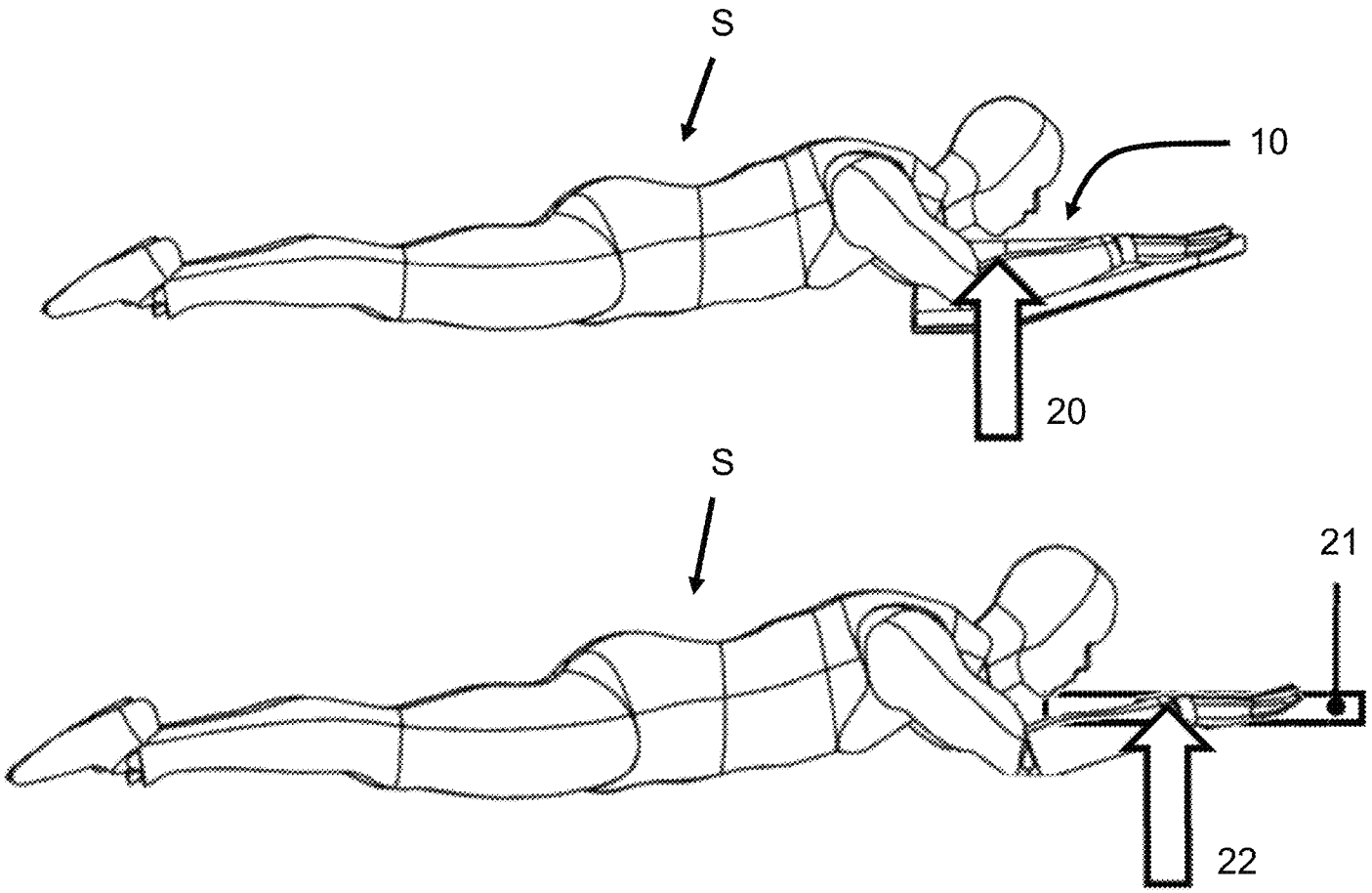
FIG. 7 shows representations of applied force with use of the disclosed kickboard and use of a conventional kickboard.

Referring to FIG. 7, the configuration of the kickboard 10 acts to provide an upward force vector 20 to the swimmer, which assists in maintaining the swimmer in the preferred prone position. The design of the kickboard 10 acts to position this force vector 20 closer to the swimmer's elbows as opposed to a standard flat kickboard 21 which positions the force vector 22 in a more forward position, closer to the mid-forearms or wrists of the swimmer. As described above, the shape of the kickboard 1, with widening primary panel 12 with support shelves 15 and support members 16 that are laterally outward and at a lower height position also provides improved support for the elbows and forearms relative to conventional kickboards.

Figure 8:
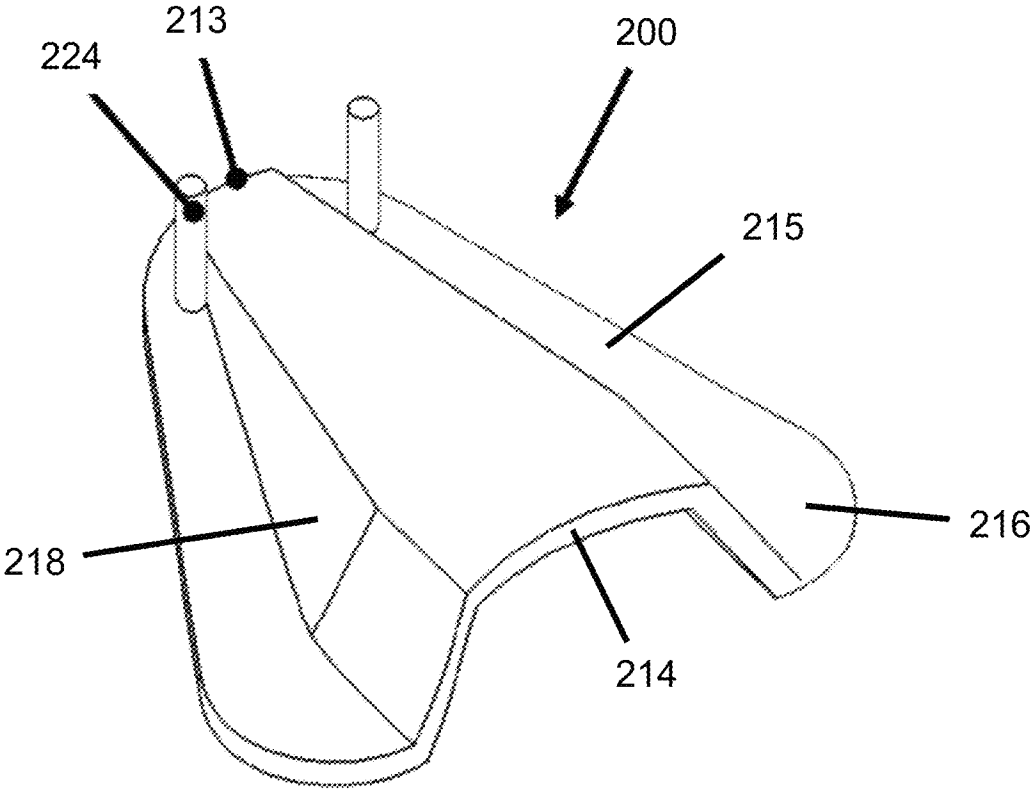
FIG. 8 depicts an embodiment of the kickboard with handles.

FIG. 8 shows an alternate embodiment of the kickboard 200 having a pair of handles 224 that extend upwardly from proximate the forward end 213 of the kickboard 200. These handles 224, shown generally as cylindrical extensions, may of course take on a variety of shapes that provide an alternate means of grasping and controlling the kickboard 200 during use. Additionally, the handles 224 may be formed as an integral part of the kickboard 200 or may be separate attachable and detachable elements. In another embodiment (not depicted) the body of the kickboard defines recesses or slots to assist in grasping the kickboard. As shown generally in FIG. 8, other than the presence the handles 224, this of the embodiment of the kickboard 200 is substantially identical to the previous embodiments, including a primary panel 212 that increases in lateral width from the forward end 213 to the rearward end 214, transitional sections 218 that transition from the primary panel 212 on each lateral edge to the support shelves 215 and support members 216, which combine to define an inner hollow portion H.

Notably, the depicted embodiments show a primary panel 10 that is substantially flat and defines a flat primary level 12*a*. However, this is a non-limiting preferred feature, as embodiments exist with a primary panel and/or primary level with a more rounded or curved contour without adversely impacting the effectiveness of the kickboard. The other positions and relationships with respect to the other elements in the kickboard remain consistent with the embodiments described in detail above.

Approximate dimensions of a preferred embodiment of the disclosed kickboard are:

Lateral width at the widest position: 20 inches

Longitudinal length: 18 inches

Height difference 17 between primary level 12*a* and support members 16: 4.5 inches Body thickness: 1.5 inches Sweep angle A: 55°

Preferably, the ratio of the longitudinal length (L) of the primary panel to the height difference 17 between the primary level 12*a* and support members 16 is within an approximate range of 2:1 to 7:1, more preferably 3.5:1 and 5.5:1, and even more preferably approximately 4.4:1.

The subject invention is formed of rigid and buoyant materials known in the art, such as a foam material.

Embodiments of the disclosed kickboard may be constructed as a singular integral unit or may be formed of separate pieces that may be disassembled for ease of storage and transport. One embodiment of the kickboard with distinct attachable components allows one or more of the transitional sections, support shelves and support members to disconnect from the primary panel, with each separable component being narrower than the width of the assembled kickboard in the lateral direction. In another embodiment the kickboard folds to its assembled configuration for use, and then may be unfolded to become substantially flat for transport.

In another embodiment, the primary panel of the board includes a section that extends more posteriorly, beyond the usual position of the swimmer's elbows to provide support for all or a portion of the swimmer's upper chest.

Although this invention has been shown and described with respect to the detailed embodiments thereof, it will be understood by those skilled in the art that various changes in from and detail thereof may be made without departing from the spirit and the scope of the invention.

What is claimed is:

1. A kickboard for use by an individual for swimming, comprising:

a primary panel defining a primary level having a top surface and opposite bottom surface and extending longitudinally from a forward end having a forward lateral width to a rearward end having a rearward lateral width that exceeds the forward lateral width;

a pair of support members, each support member being positioned laterally on an opposite side of the primary panel, rear of the forward end, and at a height beneath the bottom surface of the primary level; and a transitional section on each lateral side of the primary panel, wherein each transitional section transitions from the primary level proximate the forward end to a respective support member, and each support member is configured to receive and support a portion of the individual's arm beneath the primary level and laterally outside the primary panel.

2. The kickboard of claim 1, further comprising a pair of support shelves, wherein each support shelf is positioned on an opposite lateral side of the primary panel and transitions frontwardly from a respective support member.

3. The kickboard of claim 2, wherein the each respective support shelf and a respective support member form a substantially continuous body that is substantially free from distinct edges.

4. The kickboard of claim 2, wherein each support shelf extends from a support member and terminates longitudinally proximate the forward end of the primary panel.

5. The kickboard of claim 1, wherein the primary panel has a curved contour.

6. The kickboard of claim 1, wherein the primary panel has a substantially flat contour.

7. The kickboard of claim 1, wherein the primary panel transitions into the transitional section and the transitional section transitions to the support members with a contour that is substantially free from distinct edges.

8. The kickboard of claim 1, wherein the primary panel extends from the forward end to the rearward end a longitudinal length and the support members are positioned beneath the primary level at a height distance, and the ratio of the longitudinal length to height distance is within an approximate range of 2:1 to 7:1.

9. The kickboard of claim 8, wherein the ratio of the longitudinal length to height distance is within an approximate range of 3.5:1 and 5.5:1.

10. The kickboard of claim 1, wherein the primary panel and each transitional section define a hollow space therebetween.

11. A kickboard for use by an individual for swimming, comprising:

a primary panel defining a primary level and extending longitudinally from a forward end to a rearward end and having a lateral width;

a pair of support members, each support member being positioned laterally on an opposite side of the primary panel proximate the rear end, and at a height beneath the primary level; and a transitional section on each lateral side of the primary panel, wherein each transitional section transitions downwardly from the primary level at the rearward end of the primary panel to a respective support member, defining a hollow space between the primary panel and each transitional section at the rearward end.

12. The kickboard of claim 11, wherein the forward end of the primary panel has a forward lateral width and the rearward end of the primary panel has a rearward lateral width that exceeds the forward lateral width.

13. The kickboard of claim 11, wherein the hollow space has a substantially trapezoidal shape at the rearward end.

14. The kickboard of claim 13, wherein the hollow space narrows in a longitudinal direction from the rearward end toward the forward end.

15. The kickboard of claim 11, wherein the hollow space narrows in a longitudinal direction from the rearward end toward the forward end.

16. The kickboard of claim 11, wherein the primary panel extends from the forward end to the rearward end a longitudinal length and the support members are positioned beneath the primary level at a height distance, and the ratio of the longitudinal length to height distance is within an approximate range of 2:1 to 7:1.

17. The kickboard of claim 11, wherein the primary panel transitions into the transitional section and the transitional section transitions to the support members with a contour that is substantially free from distinct edges.

18. The kickboard of 17, further comprising a pair of support shelves, wherein each support shelf is positioned on an opposite lateral side of the primary panel and transitions frontwardly from a respective support member with a portion of each transitional section transitioning from the primary panel to each support shelf.

19. A kickboard for use by an individual for swimming, comprising:

a primary panel defining a primary level and extending longitudinally from a forward end having a forward lateral width to a rearward end having a rearward lateral width that exceeds the forward lateral width;

a pair of support members, each support member being positioned laterally on an opposite side of the primary panel, rear of the forward end, and at a height beneath the primary level;

a transitional section on each lateral side of the primary panel, wherein each transitional section transitions from the primary level proximate the forward end to a respective support member and includes a rear portion at the rearward end of the primary panel, and the primary panel and the transitional sections define a hollow space therebetween that extends forwardly from the rearward end.

20. The kickboard of claim 19, wherein the hollow space narrows in a longitudinal direction from the rearward end toward the forward end.

* * * * *